US006788280B2

(12) United States Patent
Ham

(10) Patent No.: US 6,788,280 B2
(45) Date of Patent: Sep. 7, 2004

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 107 days.

(21) Appl. No.: 09/994,041

(22) Filed: Nov. 27, 2001

(65) Prior Publication Data

US 2003/0048247 A1 Mar. 13, 2003

(30) Foreign Application Priority Data

Sep. 4, 2001 (KR) ..... P2001-54127

(51) Int. Cl.[7] ..... G09G 3/36
(52) U.S. Cl. ..... 345/89; 345/98; 345/99
(58) Field of Search ..... 345/87, 88, 89, 345/98, 99, 100, 95, 96, 209, 210, 690, 691

(56) References Cited

U.S. PATENT DOCUMENTS 4,775,891 A * 10/1988 Aoki et al. ..... 345/87
5,122,792 A * 6/1992 Stewart ..... 345/692
5,162,786 A * 11/1992 Fukuda ..... 345/100
5,495,265 A 2/1996 Hartman et al. ..... 345/87
5,541,619 A * 7/1996 Hayashi et al. ..... 345/96
5,677,704 A * 10/1997 Kusano et al. ..... 345/89
5,808,596 A * 9/1998 Kim ..... 345/98

FOREIGN PATENT DOCUMENTS

WO WO 99/05567 2/1999

* cited by examiner

*Primary Examiner*—Xiao Wu
(74) *Attorney, Agent, or Firm*—Morgan Lewis & Bockius LLP

(57) ABSTRACT

The present invention discloses a method and apparatus for driving a liquid crystal display device suitable for enhancing a picture quality. More specifically, in the method and apparatus, source data is modulated based on registered data that is previously provided therein. The modulated data is applied to a liquid crystal panel at the initial period of one frame period. A data different from the modulated data is supplied to the liquid crystal panel at the later period of the frame period.

9 Claims, 5 Drawing Sheets

VARIATION OF BRIGHTNESS BETWEEN MODULATION SYSTEMS OF THE PRESENT INVENTION AND CONVENTIONAL HIGH-SPEED DRIVING SYSTEM

METHOD AND APPARATUS FOR DRIVING LIQUID CRYSTAL DISPLAY

This application claims the benefit of Korean Application No. P2001-54127 filed on Sep. 4, 2001, which is hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for enhancing a picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a dynamic image. The active matrix LCD uses a thin film transistor (TFT) as a switching device.

The LCD has a disadvantage in that it has a slow response time due to inherent characteristics of a liquid crystal, such as a viscosity and an elasticity, etc. Such characteristics can be explained by using the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of the liquid crystal cells, and $\gamma$ represents a rotational viscosity of the liquid crystal molecules.

$$\tau_f = \gamma d^2/K \quad (2)$$

where $\tau_f$ represents a falling time at which a liquid crystal is returned into the initial position by an elastic restoring force after a voltage applied to the liquid crystal was turned off, and K is an elastic constant.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon a screen is blurred out at the moving picture.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data by using a look-up table (hereinafter referred to as high-speed driving method). This high-speed driving method allows data to be modulated by a principle as shown in FIG. 2.

Referring to FIG. 2, a conventional high-speed driving method modulates input data VD and applies the modulated data MVD to the liquid crystal cell, thereby obtaining a desired brightness MBL. This high-speed driving method increases $|V_a^2-V_F^2|$ from the above equation (1) on the basis of a difference in the data so that a desired brightness can be obtained in response to a brightness value of the input data within one frame interval, thereby rapidly reducing a response time of the liquid crystal. Accordingly, the LCD employing such a high-speed driving method compensates for a slow response time of the liquid crystal by modulating a data value in order to alleviate a motion-blurring phenomenon in a moving picture, thereby displaying a picture at desired color and brightness.

In other words, the high-speed driving method detects a variation in most significant bit data through a comparison of most significant bit data MSB of a current frame Fn with most significant bit data MSB of the previous frame Fn−1. If the variation in the most significant bit data MSB is detected, a modulated data corresponding to the variation is selected from a look-up table so that the most significant bit data MSB is modulated as shown in FIG. 3. The high-speed driving method modulates only a part of the most significant bits among the input data for reducing a memory capacity. For example, the high-speed driving method can be implemented as shown in FIG. 4.

Referring to FIG. 4, a conventional high-speed driving apparatus includes a frame memory 43 connected to a most significant bit output bus line 42 and a look-up table 44 connected to the most significant bit output bus line 42 and an output terminal of the frame memory 43.

The frame memory 43 stores most significant bit data MSB during one frame period and supplies the stored data to the look-up table 44. Herein, the most significant bit data MSB are high-order 4 bits among 8 bits of the source data RGB.

The look-up table 44 makes a mapping of the most significant bit data of the current frame Fn inputted from the most significant bit output bus line 42 and the most significant bit data of the previous frame Fn−1 inputted from the frame memory 43 into a modulation data table such as Table 1 to select modulated most significant bit data Mdata. Such modulated most significant bit data Mdata are added to an non-modulated least significant bit data LSB from a least significant bit output bus line 41 before outputting to a liquid crystal display.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |

TABLE 1-continued

| | | | | | | | | | | | | | | | | |
|---|---|---|---|---|---|---|---|---|---|---|---|---|---|---|---|---|
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In the above Table 1, a left column is for a data voltage VDn−1 of the previous frame Fn−1 while an uppermost row is for a voltage VDn of the current frame Fn.

Such a conventional high-speed driving method enhances a dynamic contrast ratio in comparison with a conventional normal driving method that does not modulate the source data. However, the conventional high-speed driving method gradually enhances brightness so that a desired brightness level is achieved at the end of one frame period. Due to this, in the conventional high-speed driving method, the dynamic contrast ratio cannot be reached at a desired level. Furthermore, a color represented by combining red, green, and blue is distorted when those colors are reproduced.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that is adaptive for enhancing a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes modulating source data using registered data previously provided and supplying the modulated data to a liquid crystal panel at an initial period of one frame period, and applying data different from the modulated data to the liquid crystal panel at a later period of the one frame period.

In another aspect of the present invention, an apparatus for driving a liquid crystal display includes a modulator modulating source data using registered data, and a data provider alternatively applying the modulated data and data different from the modulated data to the liquid crystal panel within one frame period.

In a further aspect of the present invention, a liquid crystal display includes a liquid crystal display panel displaying images and having a plurality of data lines and a plurality of scanning lines thereon, a modulator modulating source data based on registered data previously provided therein, and a data provided alternatively applying the modulated source data and the source data to the liquid crystal panel through the data lines within one frame period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 5:
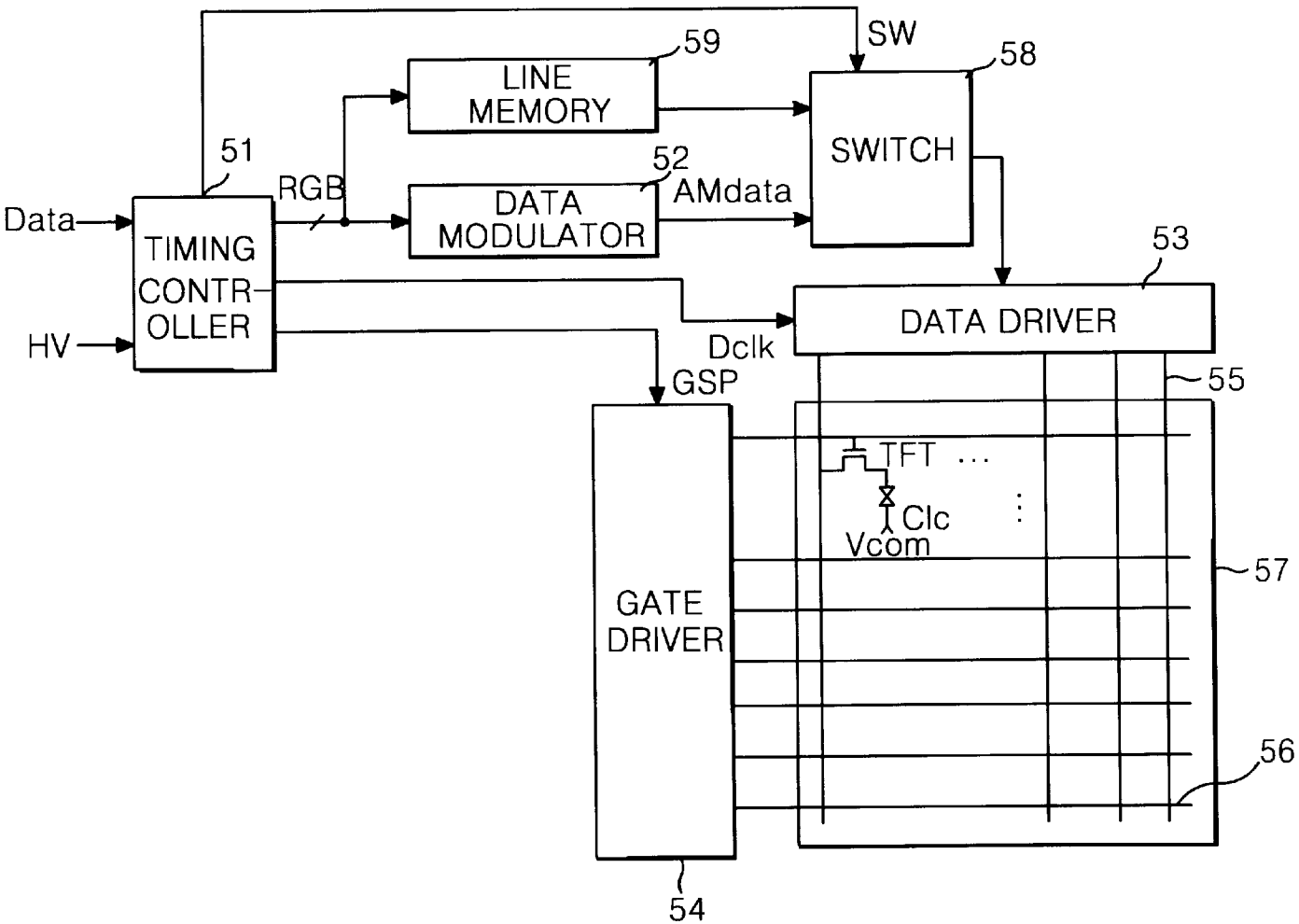
FIG. 5 is a block diagram showing a configuration of a driving apparatus for a liquid crystal display according to the present invention.

FIG. 5 is a schematic diagram for a driving apparatus for a liquid crystal display (LCD) according to the present invention.

The LCD driving apparatus includes a liquid crystal display panel 57 having a plurality of data lines 55 and a plurality of gate lines 56 crossing each other and having TFT's provided at each intersection to drive liquid crystal cells Clc. A data driver 53 supplies data to the data lines 55 of the liquid crystal display panel 57. A gate driver 54 applies a scanning pulse to the gate lines 56 of the liquid crystal display panel 57. A timing controller 51 receives digital video data and synchronizes signals H and V. A data modulator 52 is connected between the timing controller 51 and the data driver 53 to modulate input data RGB. The LCD driving apparatus further includes a switch 58 selecting any one of a modulated data AMdata and the normal input RGB. A line memory 59 is connected between the timing controller 51 and the switch 58. Herein, the normal data is non-modulated data.

The liquid crystal display panel 57 has a liquid crystal formed between two glass substrates and has the data lines 55 and the gate lines 56 provided on the lower glass substrate in such a manner to perpendicularly cross each other. The TFT provided at each intersection between the data lines 55 and the gate lines 56 responds to a scanning pulse to apply data on the data lines 55 to the liquid crystal cell Clc. To this end, a gate electrode of the TFT is connected to the gate lines 56 while a source electrode is connected to the data lines 55. The drain electrode of the TFT is connected to each pixel electrode of the liquid crystal cell Clc.

The timing controller 51 rearranges digital video data supplied from a digital video card (not shown). The RGB data rearranged by the timing controller 51 are supplied to the data modulator 52 and the line memory 59. Further, the timing controller 51 creates timing control signals, such as a dot clock Dclk, a gate start pulse GSP, a gate shift clock GSC (not shown), an output enable/disable signal, and a polarity control signal using horizontal and vertical synchronizing signals H and V to control the data driver 53 and the gate driver 54. The dot clock Dclk and the polarity control signal are applied to the data driver 53 while the gate start pulse GSP and the gate shift clock GSC are applied to the gate driver 54. Herein, frequencies of the timing control signals and the polarity control signal generated in the timing controller 51 have a polarity opposing to those of the conventional timing control signals and the prior polarity control signal. Also, magnitudes of the timing control signals and the polarity control signal are twice greater than those of the conventional timing control signals and the prior polarity signal. The timing controller 51 also provides a switching control signal SW allowing the switch 58 to be switched twice within one frame interval. To this end, the switching control signal SW is inverted in a logic value within one frame interval. In other words, the logic value of the switching control signal SW is inverted at each ½ period in comparison with the conventional vertical synchronous signal V. The timing controller 51 controls the switch 58 using the switching control signal SW.

The gate driver 54 includes a shift register sequentially generating a scanning pulse (i.e., a gate high pulse) in response to the gate start pulse GSP and the gate shift clock GSC applied from the timing controller 51. A level shifter shifts a voltage of the scanning pulse into a level suitable for driving the liquid crystal cell Clc. The TFT is turned on in response to the scanning pulse to apply video data on the data lines 55 to the pixel electrode of the liquid crystal cell Clc. Each gate start pulse GSP and each gate shift clock GSC have a frequency twice greater than those of the conventional gate start pulse and the gate shift clock. Thus, they allow all scanning lines 56 on the liquid crystal display panel 57 to be scanned twice within one frame interval.

The data driver 53 is sequentially supplied with the modulated data AMdata and the normal data RGB from the switch 58 within one frame interval. It also receives the dot clock Dclk from the timing controller 51. The data driver 53 continuously samples each of the modulated data AMdata and the normal data RGB in synchronization with the dot clock Dclk. Thereafter, the data driver 53 latches the sampled data for one line. The data for one line latched by the data driver 53 is converted into analog data and applied to the data lines 55 in each scanning period. Further, the data driver 53 may apply a gamma voltage corresponding to the modulated data to the data line 55. The dot clock Dclk has a frequency twice greater than that of the conventional dot clock. Thus, each modulated data AMdata and the normal data RGB are applied to each liquid crystal cell Clc within one frame interval.

Figure 1:
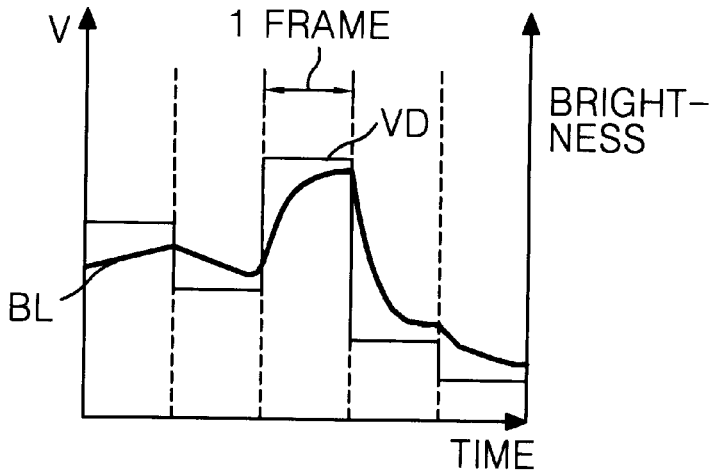
FIG. 1 CONVENTIONAL ART
FIG. 1 is a waveform diagram showing a brightness variation of a data modulation according to a conventional liquid crystal display driving method.
Figure 2:
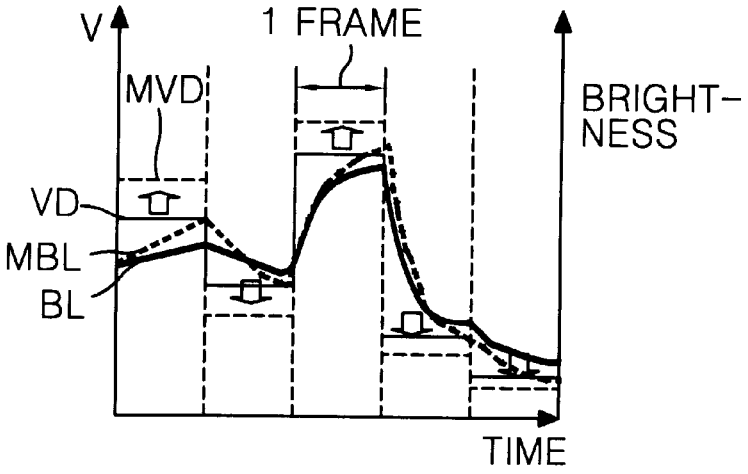
FIG. 2 CONVENTIONAL ART
FIG. 2 is a waveform diagram showing a brightness variation of a data modulation according to a conventional high-speed driving method.
Figure 3:
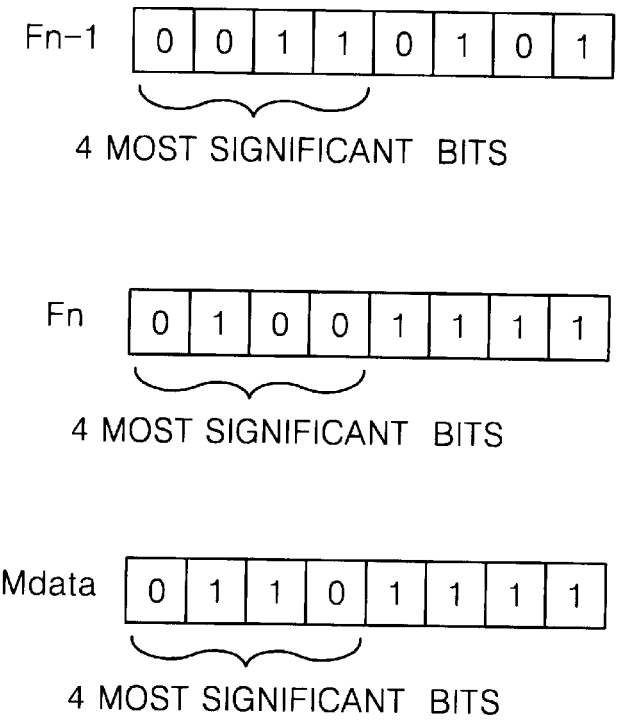
FIG.3 CONVENTIONAL ART
FIG. 3 illustrates a modulation of most significant bit data in the conventional high-speed driving apparatus using 8 bits data.
Figure 4:
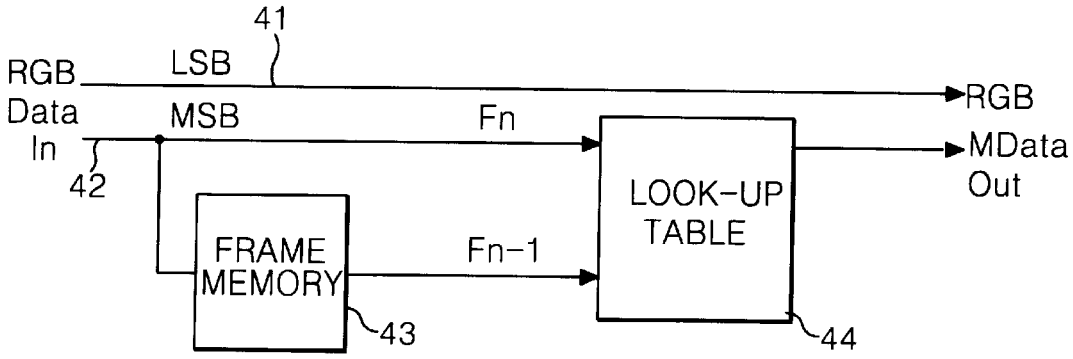
FIG.4 CONVENTIONAL ART
FIG. 4 is a block diagram showing a configuration of a conventional high-speed driving apparatus for a liquid crystal display.
Figure 6:
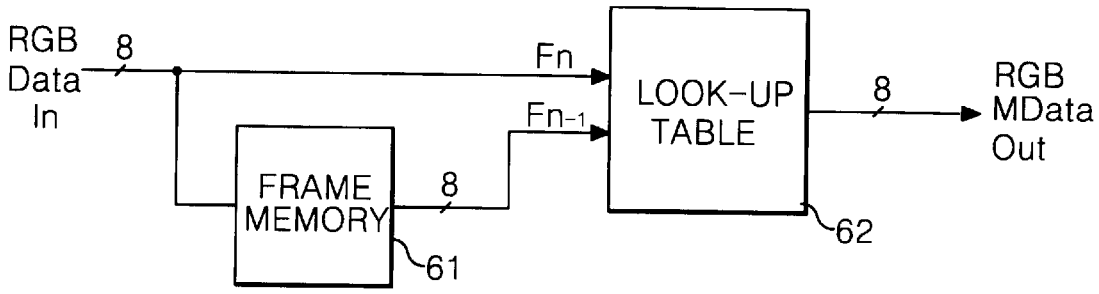
FIG. 6 is a block diagram for a data modulator of FIG. 5.

The data modulator 52 can modulate 4 most significant bits of the normal data RGB through a comparison of the data, as shown in FIG. 4. Alternatively, the data modulator 52 also can modulate the entire bits of the normal data RGB by comparing the entire bits of the normal data RGB, as shown in FIG. 6. To this end, the data modulator 52 includes a frame memory 61 storing 8 bits of the normal data RGB received from the timing controller 51 and a look-up table 62 comparing the 8 bits of the normal data from the timing controller 51 with the 8 bits of the normal data from the frame memory 61 to modulate the 8 bits of the normal data RGB into 8 bits of modulated data AMdata. Each modulated data AMdata stored into the look-up table 61 is obtained from following equation (3) to (5):

$$VDn<VDn-1 \rightarrow MDNn<VDn \quad (3)$$

$$VDn=VDn-1 \rightarrow MDNn=VDn \quad (4)$$

$$VDn>VDn-1 \rightarrow MDNn>VDn \quad (5)$$

where VDn−1 represents a data voltage in the previous frame, VDn is a data voltage of the current frame, and MVDn represents a modulated data voltage.

The switch 58 responds to the switching control signal SW from the timing controller 51 and sequentially applies the modulated data AMdata and the normal data RGB to the data driver 53 within one frame.

The line memory 59 delays the normal data RGB during the period of one line. The period of one line is a time for which the modulated data AMdata is applied to the data driver 53.

Figure 7A:
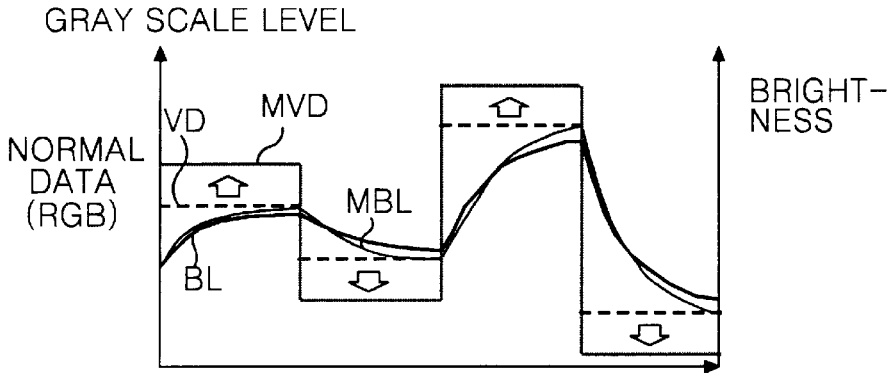
FIGS. 7A and 7B are graphic diagrams respectively showing modulated data and brightness of the conventional high-speed driving and the present invention.
Figure 7B:
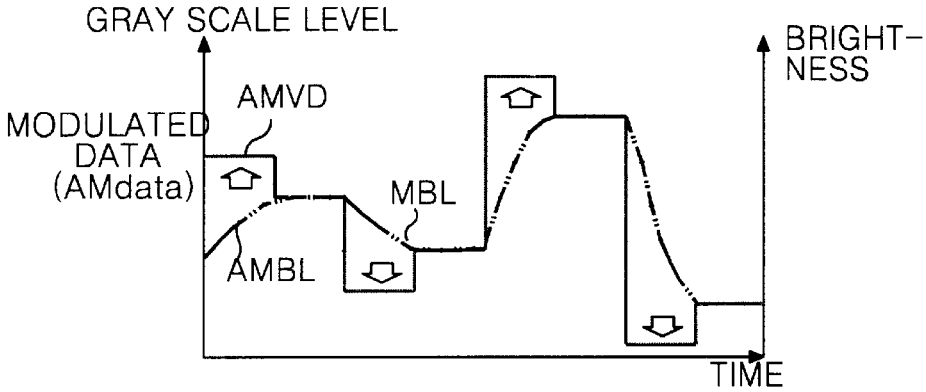
Figure 7C:
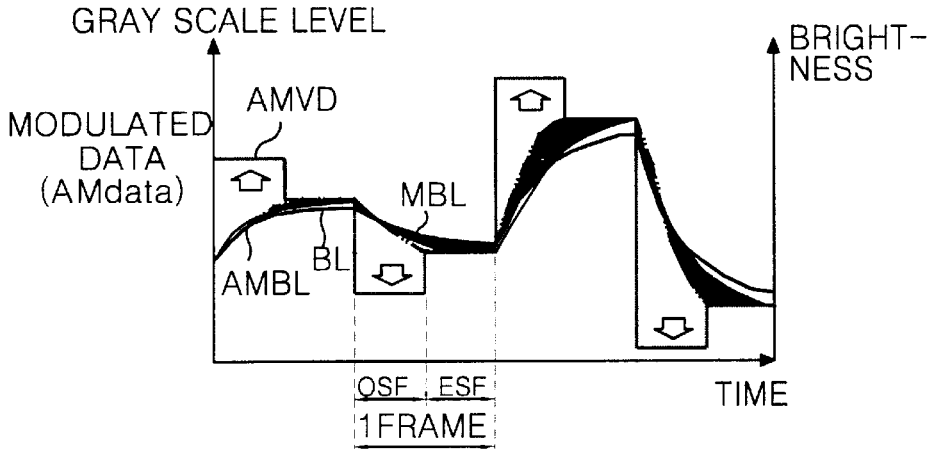
FIG. 7C is a graphic diagram illustrating an improvement indicated by a dark area.

FIGS. 7A and 7B illustrate variations in brightness in response to the applied voltage to the liquid crystal panel 57 according to the conventional art and the present invention, respectively. FIG. 7C illustrates an improvement in the variations in brightness by the present invention indicated by a dark area. One frame interval in the present invention is divided into an odd-numbered sub-field OSF and an even-numbered sub-field ESF. The period of each odd-numbered sub-field OSF and each even-numbered sub-field ESF can be appropriately adjusted within one frame interval.

In FIG. 7A, "VD" is a normal data voltage and "BL" is brightness varying with the normal data voltage VD. "MVD" is a modulated data voltage modulated by the conventional high-speed driving system and "MBL" is brightness varying with the modulated data voltage MVD. "AMVD" is a modulated data voltage modulated by the liquid crystal display driving apparatus and method according to the present invention and "AMBL" is brightness varying with the modulated data voltage AMVD.

In the odd-numbered sub-field OSF, the modulated data AMdata modulated by the data modulator 52 is applied to the liquid crystal panel 57. Continuously, the normal data RGB, which is not modulated, is supplied to the liquid crystal panel 57 during the even-numbered sub-field ESF.

Since the modulated data voltage in the first odd-numbered sub-field OSF is higher (or lower) than the normal data voltage in the even-numbered sub-field ESF, an effective voltage of the modulated data voltage applied to the liquid crystal cell Clc is higher (or lower) than that of the normal data voltage. Accordingly, brightness of the liquid crystal cell reaches at a desired brightness level within the period of the odd-numbered sub-field OSF shorter than one frame. In other words, the modulated data voltage applied in the odd-numbered sub-field OSF can be higher or lower than the inputted current normal data voltage depend upon conditions satisfying the above equations (3) to (5).

On the other hand, the normal data voltage applied in the even-numbered sub-field ESF forces to maintain the desired brightness level achieved at the odd-numbered sub-field OSF during the period of the even-numbered sub-field ESF.

As shown in FIG. 7C, the liquid crystal display drive apparatus and method according to the present invention allow the brightness of the liquid crystal panel 57 to arrive rapidly at the desired brightness level and to maintain the desired level during the constant period. Meanwhile, the conventional high-speed driving system forces to each the desired brightness level only at the end of the frame because the brightness is gradually varied with the modulated data maintaining a constant voltage within one frame.

On the other hand, the modulated data AMdata of the high-speed driving apparatus according to present invention can be adjusted to be higher than that of the conventional high-speed driving system. Due to this fact, if the modulated data AMdata of the present invention is applied to the liquid crystal panel 57 through the entire period of the frame in such a manner to identify with the conventional high-speed driving system, a white pattern (non-desired) may be generated by an over-shoot. In such a case, a picture quality may be deteriorated.

As described above, the LCD drive apparatus and method according to the present invention apply the normal data to the liquid crystal panel at the initial half period of the frame after supplying of the modulated data to the liquid crystal panel during the later half period of the frame. Thus, a desired brightness level is achieved within the initial period of the frame. Accordingly, the LCD drive apparatus and method in the present invention enhances a dynamic contrast and a color reproducibility. As a result, the LCD drive apparatus and method of the present invention provide with a high display quality.

The data modulator 52 may be implemented by other means, such as a programmable software and a microprocessor for carrying out the present invention, rather than a look-up table. The present invention can also be applied to a digital flat display device, which requires a data modulation, such as a plasma display panel, an electroluminescence display device, and an electric field emitting device and so on. Furthermore, the switch and the line memory can be combined in one unit together with the timing controller or the data driver.

It will be apparent to those skilled in the art that various modifications and variations can be made in the method and apparatus for driving the liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

modulating source data using registered data previously provided and supplying the modulated data to a liquid crystal panel at an initial period of one frame period; and applying data different from the modulated data to the liquid crystal panel at a later period of the one frame period, further comprising:

dividing the source data of a current frame period into most significant bit data and least significant bit data;

delaying the most significant bit data for one frame period; and selecting the modulated data through a comparison of the current and delayed most significant bit data.

2. A method of driving a liquid crystal display, comprising:

modulating source data using registered data previously provided and supplying the modulated data to a liquid crystal panel at an initial period of one frame period; and applying data different from the modulated data to the liquid crystal panel at a later period of the one frame period, further comprising:

delaying entire bit data of the source data for one frame period; and selecting the modulated data through a comparison of the current and delayed entire bits of the source data.

3. An apparatus for driving a liquid crystal display, comprising:

a modulator modulating source data using registered data previously provided therein; and a data provider alternatively applying the modulated data and data different from the modulated data to the liquid crystal panel within one frame period, wherein the modulator comprises, a delay circuit delaying most significant bit data of the source data of a current frame and outputting one frame delayed most significant bit data; and a look-up table selecting the registered data through a comparison of the current and delayed most significant bit data.

4. An apparatus for driving a liquid crystal display, comprising:

a modulator modulating source data using registered data previously provided therein; and a data provider alternatively applying the modulated data and data different from the modulated data to the liquid crystal panel within one frame period, wherein the modulator selects the registered data through a comparison of entire bits of the current and delayed source data.

5. An apparatus for driving a liquid crystal display, comprising:

a modulator modulating source data using registered data previously provided therein; and a data provider alternatively applying the modulated data and data different from the modulated data to the liquid crystal panel within one frame period, wherein the data provider comprises, a switch alternatively switching the data and the modulated data;

a timing controller applying the source data to the modulator and controlling a switching time of the switch; and a line memory holding the data for less than one frame period and outputting the data to the switch.

6. The apparatus according to claim 5, wherein the timing controller generates a switching control signal inverted in a logic value within the one frame period to alternatively switch the modulated data and the source data within the one frame period.

7. The apparatus according to claim 5, wherein the timing controller generates a dot clock at a frequency twice greater than that of the source data to sequentially select the modulated data and the source data within the one frame period.

8. The apparatus according to claim 5, wherein the switch alternatively switches the source data and the modulated data at a half period of the one frame period.

9. A liquid crystal display comprising:

a liquid crystal display panel displaying images and having a plurality of data lines and a plurality of scanning lines thereon;

a modulator modulating source data based on registered data previously provided therein; and a data provider alternatively applying the modulated source data and the source data to the liquid crystal panel through the data lines within one frame period, wherein the data provider comprises, a switch alternatively switching the data and the modulated data;

a timing controller applying the source data to the modulator and controlling a switching time of the switch; and a line memory holding the data for less than one frame period and outputting the data to the switch.

* * * * *